US005803788A

United States Patent [19]

Penberthy et al.

[11] Patent Number: 5,803,788

[45] Date of Patent: Sep. 8, 1998

[54] FIGURINE HAVING A SUBLIMATED IMAGE FOR A FACE

[76] Inventors: Doreen T. Penberthy, 29711 Wells Rd., Wesley Chapel, Fla. 33544; Darci T. Wattam, 2210 Minneola Rd., Clearwater, Fla. 34624

[21] Appl. No.: 643,083

[22] Filed: May 2, 1996

[51] Int. Cl.[6] ..... A63H 3/36

[52] U.S. Cl. ..... 446/391

[58] Field of Search ..... 446/391, 390, 446/394, 372, 387, 395, 393, 392

[56] References Cited

U.S. PATENT DOCUMENTS

| | | | |
|---|---|---|---|
| 2,199,049 | 4/1940 | Greenberg | 446/391 X |
| 4,450,129 | 5/1984 | Dunn et al. | 446/391 X |
| 4,648,188 | 3/1987 | Blair | 446/391 X |
| 4,929,213 | 5/1990 | Morgan | 446/369 X |
| 5,009,626 | 4/1991 | Katz | 446/391 |
| 5,234,983 | 8/1993 | Valenty | 524/283 |
| 5,314,370 | 5/1994 | Flint | 446/391 |
| 5,516,314 | 5/1996 | Anderson | 446/390 X |

FOREIGN PATENT DOCUMENTS

| | | | |
|---|---|---|---|
| 0418730 | 3/1991 | European Pat. Off. | 446/391 |

*Primary Examiner*—Robert A. Hafer
*Assistant Examiner*—D. Neal Muir
*Attorney, Agent, or Firm*—Pendorf & Cutliff

[57] ABSTRACT

The present invention concerns a figurine with a picture image for a face, and in particular, to a ceramic figurine and process for producing a ceramic figurine which has a transferred photograph image for a face. Difficulties associated with dye sublimating a photographic or other image onto a three dimensional figure can be overcome by utilizing a substantially three-dimensional representative head having a planar facial region. By utilizing a flat/planar facial region a standard flat heat press system may be utilized to sublimate an image into the coating of a ceramic figure. The resulting image is unexpectedly clear and lifelike with a smooth appearance and no sharp edges.

3 Claims, 5 Drawing Sheets

FIGURINE HAVING A SUBLIMATED IMAGE FOR A FACE

BACKGROUND OF THE INVENTION

1. Field of the Invention

The present invention concerns a figurine with a picture image for a face, and in particular, to a ceramic figurine and process for producing a ceramic figurine which has a transferred photograph image for a face. The ceramic figurine of the present invention is realistic looking, customizable, and enduring such that it may be a keepsake for many years.

2. Description of the Related Art

Generally, a doll is a small representative figure of a human being and has traditionally been considered a child's toy. Dolls have been known since ancient times. In Europe, during the 15th century, "fashion dolls" which were given as gifts by monarchs and courtiers helped spread costume styles. Germany was noted for manufacture of wooden dolls during the 17th century and of china doll's heads during the 19th century. In Paris during the 18th century, dolls were manufactured that could speak and close their eyes. In the 19th century dolls were made of fabric, paper-mache, china, wax, hard rubber or bisque. By the 20th century doll manufacturing was an important U.S. industry.

Dolls are not exclusively children's toys. Many individuals purchase figurines and dolls as collectibles. Collectible dolls and figurines are often displayed on shelves or in curio cabinets.

In addition to mass produced commercially available dolls, and even more limited edition collector's dolls, there is a need for a doll which can be customized or personalized by the purchaser.

Specifically, a mother might want a doll representative of her child at a particular age or a grandparent might want dolls representative of her grandchild(ren). The demand for customizable and personalized items bearing photographic images is evidenced by the recent increase in sales of personalized computer image T-shirts and coffee mugs.

Additionally, an individual may want to create a figurine which is representative of a sports hero, historical figure or even a figurine which is representative of a pet.

Since dolls and figurines have been in existence for centuries there are numerous examples of specialized dolls in the prior art. For an extensive discussion of the history of dolls see U.S. Pat. No. 5,009,626 (Katz), incorporated herein by reference. Prior attempts to produce dolls which are personalized or customizable have utilized several different approaches. One approach is simply to adhere or attach a photograph of a face onto the facial region of a doll.

For instance, U.S. Pat. No. 833,448 which issued in 1906 teaches a figure representing a living form and having its facial portion blank and covered with a sensitized film adapted to have a positive photograph taken thereon. However, the resulting figure is not realistic in appearance.

U.S. Pat. No. 2,199,049 (Greenberg) teaches a doll provided with "interchangeable faces", having an enlarged and relatively flat front face portion to which a representation of a human face is detachably affixed. However, given the affixing means and configuration of the head, the invention of Greenberg is not realistic in appearance.

U.S. Pat. No. 5,403,224 (Gintling) teaches a doll having a transparent pocket secured to the face portion of the doll for displaying a photograph. Releasable fasteners may be utilized to secure the pocket to the face portion. The invention of Gintling does not provide a realistic appearing customizable doll, rather the releasable sealing pocket is utilized to ensure that the doll may be washed and the photographic image readily changed or replaced.

Another approach utilized in the attempt to produce a customized representational doll is to transfer an extrapolated photographic image of a real life subject onto a flat flexible fabric material and then attempt to manipulate the material into a three dimensional shape. See for instance U.S. Pat. No. 5,009,626 (Katz) and U.S. Pat. No. 4,659,319 (Blair).

An additional approach to produce a customized representational doll is to use a complex computer process to transfer ink to a three dimensional head. U.S. Pat. No. 5,382,187 (Wilson) highlights the difficulties long associated with attempting to transfer an image to a three-dimensional product. Wilson teaches a fabric doll constructed such that a computer portrait may be transferred to the face without wrinkling the fabric. Specifically, the panel which forms the facial region of the doll is cut out on the straight of the material to ensure that it does not stretch or wrinkle during the pressure of the heat press process.

However, while the patent to Wilson teaches a flat-faced fabric doll which can accept the transfer of a computer generated portrait directly on its face without wrinkling, the resulting doll head is not three-dimensional, lifelike in appearance or suitable as a keepsake. The doll of Wilson utilizes multiple fabric panels to comprise the head (side panel, a face panel, and extension of the back body panel). The face panel is sewn to the front of the side of the head panel and the upper silhouette to the back of the side of the head panel thereby creating a chamber into which material can be stuffed to for the head of the doll. In theory, once a sufficient amount of material is compacted into the chamber the upper silhouette of the head will be shaped substantially spherical while the face panel of the head of the doll will be substantially flat such that a photograph of an individual's face may be transferred thereon. However, compacting material into a fabric chamber is likely to result in an uneven distribution of the stuffing material, lumps and a generally unrealistic appearance. Further, dimensional physical characteristics such as ears can not be incorporated into a fabric doll head. Lastly, use of a fabric base material results in an end product which is not as durable, smooth or refined.

Endeavors have been made to produce more sturdy dolls in which a photographic image is impregnated into the substrate material of the doll rather than simply adhering a photograph to the doll. U.S. Pat. No. 4,993,987 (Hull et al.) teaches a fabric doll having a personalized, photographic face, impregnated in the material of which the doll is constructed. However, owing to the rough texture of the substrate, image clarity is limited.

Similarly, U.S. Pat. No. 5,314,370 (Flint) teaches a doll making process which includes the steps of positioning the subject in front of a video camera, adjusting the subject such that the face fills certain parameters on a monitor screen, and transferring the signal from the video camera to a color transfer printer. The resulting image is then transferred onto a layer of fabric which is then incorporated into the facial area of a doll. As in prior attempts to customize dolls, the resulting doll is unrealistic in appearance and not particularly lifelike.

All of the above-mentioned approaches to customize a doll suffer from disadvantages which limit their usefulness and applicability to the present need. Specifically, the dolls which result from the foregoing approaches are unrealistic in appearance, are intended largely for use as children's toys rather than enduring keepsakes and result in "ragdolls" rather than a figurine having a valuable and lifelike appearance. Additionally, the methods utilized in the prior art are too expensive and complex to be employed by smaller specialty shops or manufacturers. For the foregoing reasons, there is a need for a simple method for producing a permanent ceramic figurine with an aesthetically pleasing realistic looking facial image, and figurine produced thereby.

SUMMARY OF THE INVENTION

In view of the foregoing disadvantages inherent in current customizable representative dolls, specifically the absence of an aesthetically pleasing realistic looking facial image with natural appearing coloring and expression, it is an object of the present invention to provide an artistic and visually pleasing custom doll with a photo image for a face and method for producing the same.

It is a further object of the present invention to provide a ceramic doll which has a photographic image of a face dye sublimated into the material of which the doll face is manufactured in such a manner as to make it a lasting image.

It is a further object to provide a simple method for producing a doll that has a photographic image of an child, so that a series of dolls can be readily created at differing times of the child life, which evidence the growth of the child and preserve as keepsakes the lifelike images of the child.

It is a further object to provide a doll, with the facial portion bearing a sublimated photographic representation of the face of a real life individual, which appears realistic.

It is a further object of the invention to provide a method for producing custom and personalized dolls.

It is a further object to provide a method for enhancing the facial features of the photographic image sublimated into the facial portion of the figurine (i.e., to provide whiter eyes, redder lips, and a "glint" in the eye).

After extensive investigation and experimentation, the present inventors have found that these and other objects are accomplished by providing a doll having a ceramic (i.e. porcelain, etc.) head and a fabric or ceramic body, of which the facial portion can be customized by use of dye sublimation, to form a doll which is characterized by a lifelike appearance and clear image.

A significant feature of the present invention resides in the use of a level flat portion on an otherwise three-dimensional doll head. Preferably, the facial region of the doll head is planar with the remainder of the head being representational of a human head, including ears. Hair may be formed in the ceramic head, or soft fibers simulating hair may be adhered to the head. By utilizing a planar facial region the present inventor has overcome significant difficulties faced by those attempting to customize figurines by dye sublimation of photographic images. Particularly, the use of a flat planar facial region lends to ease in transferring a high quality, enhanced photographic image plus a surprisingly likelife appearance in the resulting figurine.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and specific embodiments disclosed may be readily utilized as a basis for modifying of designing other ceramic dolls with dye sublimated photographs for faces for carrying out the same purposes of the present invention. It should also be realized by those skilled in the art that such equivalent dolls do not depart form the spirit and scope of the invention as set forth in the appended claims.

BRIEF DESCRIPTION OF THE DRAWINGS

Further objective and advantages of the present invention will become apparent from a careful reading of the detailed description provided hereinbelow, with appropriate reference to the accompanying drawings.

DETAILED DESCRIPTION OF THE INVENTION

Figure 1:
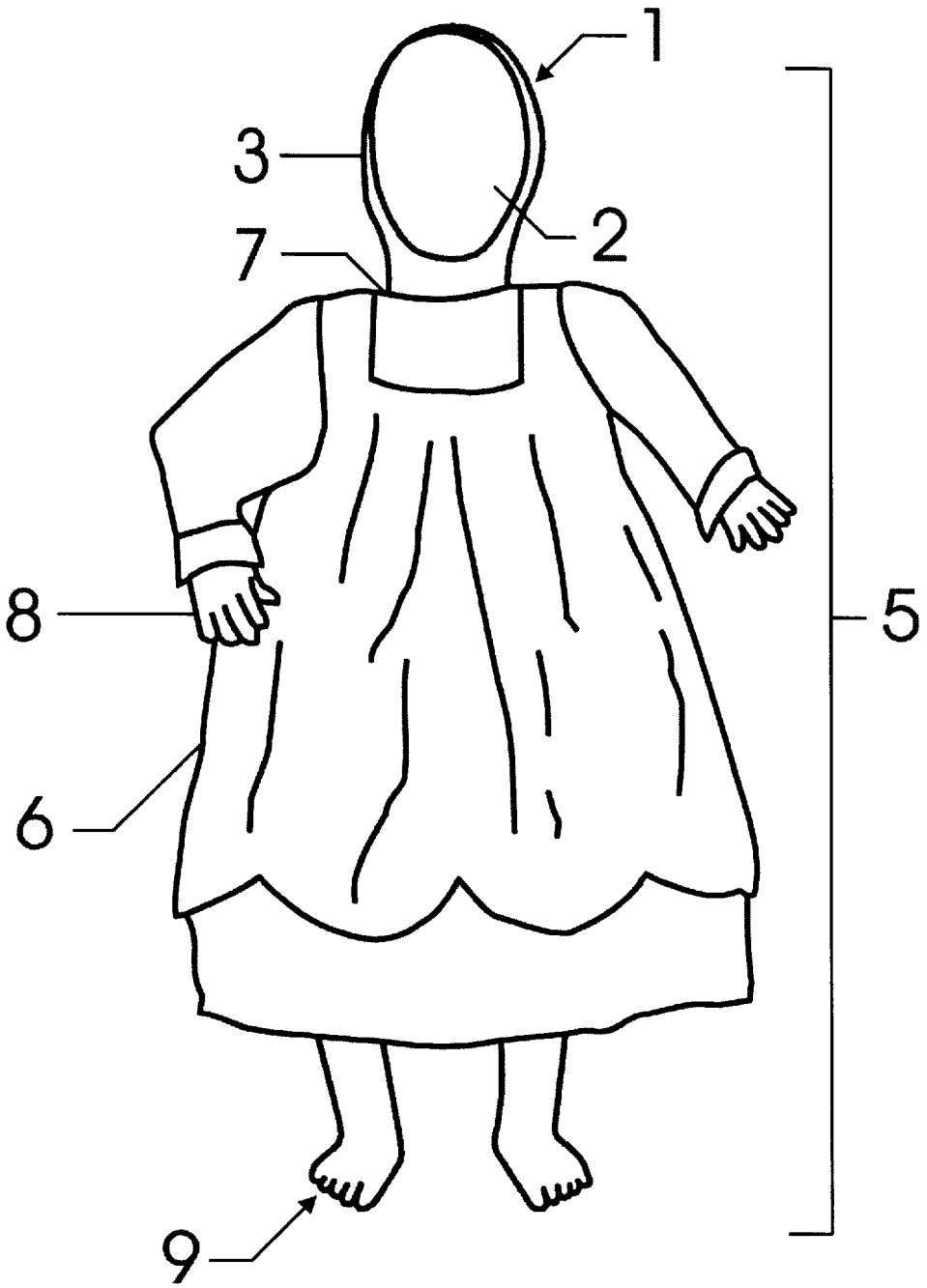
FIG. 1 is a front elevation view of a figurine manufactured in accordance with the present invention.

After extensive investigation, the present inventors have discovered that current difficulties associated with dye sublimating a photographic image onto a three dimensional figure can be overcome by utilizing a substantially three-dimensional representative head having a planar facial region. By utilizing a flat/planar facial region a standard flat heat press system may be utilized to sublimate a photographic image into the coating of a ceramic figure. The resulting image is unexpectedly clear and lifelike with a smooth appearance.

The components of the figurine of the present invention may be constructed of any materials commonly utilized in the doll manufacturing art. Preferably, the doll has a pliant body with semi-rigid or rigid extremities and a rigid head. Most preferably, the body of the doll of the present invention is made of cloth and the extremities and head are formed from ceramic. However any rigid or semi-rigid material which can withstand heat press temperatures without deforming may be utilized. For instance plastic, rubber, wood or cellulosic materials which have been treated with a coating to improve dye receptivity may be suitable.

The preferred method for manufacturing the ceramic figurine of the present invention involves a multi-step process. Each step may be varied and utilize varying components without departing from the spirit and the scope of the present invention.

For illustrative purposes, the invention will be described with reference to a ceramic headed doll. First, a suitable clay material to produce the desired grade and physical attributes required in the end product is selected. Ceramics (Greek keramos, "potter's clay"), was originally the art of making pottery. Now, it is a general term for the science of manufacturing articles prepared from pliable, earthy materials that are made rigid by high-temperature treatment. The nature and type of pottery, or ceramics, is determined by the composition of the clay and the way it is prepared; the temperature at which it is fired; and the glazes used. Ceramic materials are nonmetallic, inorganic compounds, primarily oxides, but also carbides, nitrides, borides, and silicides. Ceramics are materials that have been permanently hardened by firing at a high temperature. Most ceramics resist heat and chemicals. Ceramic materials are used in all forms of pottery, form crude earthenware to the finest porcelain.

Earthenware is porous pottery, usually fired at the lowest kiln temperatures (900°–1200° C./1652°–2192° F.). Depending on the clay used, it turns buff, red, brown, or black when fired. To be made waterproof, it must be glazed. Stoneware, water-resistant and much more durable, is fired at temperatures of 1200°–1280° C. (2191°–2336° F.). The clay turns white, buff, gray, or red and is glazed for aesthetic reasons. Pottery fired at about 1200° C./2192° F. is sometimes called middle-fire ware; its earthenware or stoneware traits vary from clay to clay. Porcelain is made from kaolin, a clay formed from decomposed granite. Kaolin is a primary white clayuone found in the earth in the place where it was formed and not transported there by rivers; secondary clays, river borne to the site of deposit, contain impurities that give it various colors. Porcelain is fired at 1280°–1400° C. (2336°–2552° F.); it is white and often translucent.

Once the type of clay material to be utilized in the present invention is selected, the clay must be formed into a three dimensional head with a substantially planar facial portion. The plasticity of clay allows pottery to be shaped in several traditional ways. Clay can be flattened and then shaped by being pressed against the inside or outside of a mold. Liquid clay can be poured into plaster molds. In the present invention, the three dimensional heads are preferably formed by pouring liquid clay into multiple molds thereby permitting the manufacture of numerous three dimensional heads at the same time. In order to proceed with the initial "firing" without risk of breaking the ceramics, the clay must first be air dried. Generally, the greenware extracted from the mold is allowed to dry from 48–96 hours depending on the thickness of the piece and environmental conditions.

Preferably, the ceramic head is fired in successive stages. Firing occurs in a kiln, which is a general name for one of several kinds of furnace, heated electrically or by the combustion of fuel, used to fire pottery or other ceramic products. Kilns in general are of two types: intermittent kilns, in which the fire must be extinguished while the kiln is being unloaded and recharged with another batch of material to be fired; and continuous kilns, in which loading and unloading is accomplished while the kiln is lit. The various forms of continuous kilns are particularly suited to mass production manufacture. The two most important types of continuous kiln are the tunnel kiln, in which the material heated is moved through a long combustion chamber or heating zone on carts or conveyors, and the rotary kiln, in which the material is moved through a long, inclined, rotating combustion chamber by the force of gravity. For instance Electric Kiln, SCUTT Model 1227 manufactured by Electric Kiln is a suitable kiln.

Once the greenware has completed an initial firing (known as firing to bisque) it may then glazed to impart a smooth finish and if desired add color such as flesh tones. Glaze is a form of glass, consisting basically of glass-forming minerals (silica or boron) combined with stiffeners (such as clay and fluxes) and melting agents (such as lead or soda). In raw form, glaze can be applied either to the unfired pot or after an initial unglazed, or biscuit firing. Preferably, a pigmented glaze is utilized in the present invention to impart a realistic skin tone to the figurine. Alternatively, the glaze utilized may be clear. Once glazed, the ceramic is then glaze fired; the glaze ingredients must melt and become glasslike at a temperature that is compatible to the kiln temperatures required by the chosen clay base material. In the present invention a glaze is applied to the ceramic head and any ceramic extremities. The glaze may be applied to the three dimensional head and if desired to the rigid extremities by dipping or spraying. The glaze coating is intended to provide a stable layer for fixing the image to the surface of the facial area and help preserve the image for an extended period of time. Many kinds of glazes are commercially available. For instance Duncan, IN-1044, San Diego Envision Glaze Opaque, manufactured by Duncan Enterprises, is a suitable ceramic glaze. Preferably, the thickness of the decorative glaze should be one to three coats by dipping, spraying or brushing the glaze onto the figurine. The thickness of the glaze will vary depending on the application process.

Alternatively, the clay may be "continuous color" where flesh toned pigment is incorporated into the clay itself thereby eliminating one of the firing steps in the manufacture of the ceramic head.

Once the three dimensional head with a planar facial region has undergone the secondary or final firing a specialized coating is then applied to the facial portion to enable a photograph to be sublimated onto the three-dimensional head. Since in sublimation transfer, the image is dyed into the substrate, this type of transfer process is only suitable for printing on items with a sublimation-receiving coating. Numerous coating materials suitable for dye sublimation are available, the coating is a polymeric material selected from the group consisting of epoxies, acrylics, polyesters, and polyurethane, or mixtures thereof. Polyurethanes provide the best image quality, while epoxy materials provide the best adhesion.

U.S. Pat. No. 5,234,983 (Valenty), the disclosure of which is incorporated herein by reference, teaches sublimation-transfer receptor surface coating for ceramic articles. Specifically, a coating composition for a substrate to be imprinted with an image by means of sublimation or heat transfer comprises a mixture of an epoxy resin and a blocked polyisocyanate in an equivalent-weight ratio in a range from 0.5 to 1.8 in appropriate solvents. When this coating composition is cured, the result is a low glass-transition temperature polyurethane that is smooth, colorless, tough, clear, glossy and capable of accepting a reproduction of the transfer print. Valenty also teaches alternative formulations, varying the amounts of epoxy, propylene and polyarylate, depending on the clarity or adhesion desired in the resultant coating.

Further refinements to the coating material of the present invention may include an appropriate solvent carrier, a flow modifier and ultraviolet screens and absorbers to increase colorfastness.

The coating may be applied to the rigid substrate to be imprinted with an image by sublimation in any of the known means available for application of thin layers of material to a supporting substrate. Preferably, the coating is applied by spraying or dipping the three dimensional head in a liquid bath.

Several polymeric coating materials and equivalents, which may serve as a coating and sublimation substrate, for the doll face of the present invention are currently available commercially. For instance, Polyester Coating 1410 Series, manufactured by Pinnacle Paints & Coatings, Inc. is suitable.

Differing thickness of coating material may be applied to the doll head and face of the present invention. Preferably, the thickness of the coating should be one of three coats by dipping, spraying or brushing the coating on to the figurine. The thickness of the coating will vary depending upon the application process.

Once the three dimensional head with the planar facial region has been glazed, fired and a suitable coating material applied it is ready to accept a dye sublimated photographic image.

Use of computer generated photographs was initially developed in the late 1960's and it is now commonplace to utilize a video camera or photographic scanner to feed an image into a computer which can then download the image to a high speed printer. To form the photographic image to be sublimated into the figurine the client can provide a "standard" photograph suitable for scanning, a digital photograph on disk, a videotape or an image can be created utilizing a camera such as JVC TK1070U manufactured by Sony Corporation. In either approach the image to be sublimated onto the facial region of the figurine may be color and clarity enhanced.

Generally speaking, sublimation or heat transfer printing is a printing process utilizing specialized inks, whereby an image is transferred to a receptor surface from a sublimable transfer image print. The process of imprinting an article via sublimation consist of converting a picture into a digital image and transferring it onto a diffusible or sublimable transfer image print. Sublimation transfer image prints contain an image made up of special sublimating dyes which, when subjected to heat and pressure, dye the surface of an item.

Modern digital input, techniques allow images to be manipulated and retouched on a computer, with precise control and great flexibility. While a variety of commercially available scanners and cameras are used to convert photographic or hand-drawn originals into digital data, we have found that a flatbed scanner, such as a Microtek 1200 dpi Scanner manufactured by Microtek Lab., Inc. provides good results.

Digital images consist of a grid of small squares, known as picture elements or pixels. A scanned digital image is composed of a matrix or bit map of touching pixels, which are small squares of small black, white varying grey tones or color. Bit maps are either square or rectangular.

Every digital or bit-mapped image has four basic characteristics: resolution, dimensions, bit depth, and color model. When the image is scanned, the number of samples or readings to be recorded in a given distance must be specified. This is known as the scanning resolution, which is normally specified in pixels per inch (ppi) or samples per inch (spi).

Bit maps always consist of whole numbers of pixels, so although dimensions may be given in inches or centimeters, measurements are more simply stated in pixels. Division of the number of pixels in the height and width of a bitmap by its resolution provides the physical size. For example, if an image is scanned at 200 ppi and the width and height are 800 pixels, the physical size is four inches square (800/200). When the resolution is changed to 100 ppi, the physical size will be eight inches square (800/100). The number of pixels has not changed but they are now four times as big (double the width and height). Keeping image resolution in the correct relationship to the intended output device minimizes file sizes and ensures efficient processing the printing.

If an original will need to resized, the scanning resolution should be adapted accordingly. For example, a 5 cm×5 cm photograph has to be scanned and enlarge to a size of 20 cm×20 cm. This is a sizing factor of 4 (20 cm/5 cm), meaning that the adapted scanning resolution needs to be four times as high as the desired final image resolution. When a final resolution of 200 ppi is required, the original photograph will be scanned at 800 ppi (200×4). Some scanner interfaces allow output size and resolution to be specified, avoiding the need to calculate sizing factors.

Once the image is scanned into the computer, commercially available image editing software applications such as Adobe Photoshop or CorelDRAW can be used to make changes to the imported digital image. Desired modifications may be enhancing or changing colors, sharpening edges or borders, adding consistency or evening color tones, removal of shadows or blemishes, resizing the image, and the like. After the image editing process has been completed, the image is then ready to be printed.

In the present invention the specialized medium or image transfer process, used to create the transfer image sheet, may be UltraGraphics, manufactured by XPress Corporation. Using a matrix scanner, color photographs are scanned for the three basic colors (yellow, red, and blue). A wide variety of image input, generation, manipulation, and output functions can be performed in a calibrated manner which adjust for the idiosyncracies of the input and output devices (i.e. color separation process). The dyes used for the transfer print are capable of diffusing or sublimating from the transfer print onto another receptive surface when the two surfaces are brought into intimate contact using a combination of heat and pressure.

Based upon the image data fed from various image input means a thermal head is actuated to execute printing operation through a dyestuff film (thermal image-transfer sheet) on an image-transfer material. The dyestuff on the dyestuff film is transferred or shifted under the influence of heat energy from the thermal head onto the image-transfer material through sublimation, thereby creating a transfer image sheet.

Use of a computer-based thermal transfer system, such as UltraGraphics, sold by Xpres Corporation, Winston-Salem, N.C. is preferred in manufacturing the figurine of the present invention. Specifically, use of a computer-based thermal transfer system allows the user to create transfer image sheets with multiple colors and "blend together" the primary colors (red, yellow and blue) to create a nearly infinite blend of other colors, e.g. flesh tones, shades of green, purple, etc. The UltraGraphics system utilizes a color printer and special ribbon to produce sublimation transfer image sheets, no toner is involved. The sublimation ribbon is actually a roll of thin plastic impregnated with sublimating dyes (yellow, blue and red).

Once the digital image has been prepared, and the sublimation ribbon into a printer, the transfer image sheet may be printed. Once the printer receives the print command, sublimation paper feeds into the printer and the first color (yellow) is applied. The printer's thermal head applies heat and pressure to transfer pinpoint sized dots of pigment/dye from the sublimation ribbon to the sublimation paper. Once the first color is applied, the paper reverse-feeds back to the original starting point and the sublimation advances to the next color (red). The sublimation paper then advances through the printer and the red pigment/dye is applied. The procedure is then repeated to transfer the blue pigment to the sublimation paper. The transfer image sheet is now ready to sublimate into the planar facial region of a figurine utilizing a heat press.

Heating is carried out at 375°–500° F. for 60 seconds to 3 minutes, depending on how fast the heat element is able to bring the transfer image sheet to the temperature at which the dyes diffuse or sublimate and the temperature at which the receiving surface is able to release the dyes. In the present invention, Model 994 Flat Press, manufactured by George Knight and Co. is a suitable heat element. Preferably, a specialized holder sized to accommodate the rigid head of the present invention is utilized to prevent movement of the rigid head during the heat press process.

Differing dye sublimation processes may be utilized depending on the substrate media to which the image is ultimately to be transferred. A predominance of the patent literature pertains to the use of textiles as a receiving media. See for instance, U.S. Pat. No. 5,431,501 (Hale et al.) incorporated herein by reference. Most likely, this is due in part to the difficulties associate with sublimating to, or heat pressing, an irregularly shaped rigid substrate article.

Further examples of coating material/dye sublimation techniques and computer enhanced imagery are disclosed by the following U.S. Patents, the disclosures of which are incorporated herein by reference:

| | |
|---|---|
| 4,923,934 | INTERPENETRATING POLYMER NETWORK OF BLOCKED URETHANE PREPOLYMER, POLYOL, EPOXY RESIN AND ANHYDRIDE |
| 5,250,133 | METHOD FOR RECORDING IMAGES AND APPARATUS FOR RECORDING IMAGES |
| 5,271,096 | METHOD AND STRUCTURE FOR CALIBRATING A COMPUTER GENERATED IMAGE |
| 5,451,560 | IMAGE FORMATION ON OBJECTIVE BODIES |
| 5,832,187 | DOLL HAVING A PHOTOGRAPH FOR A FACE |

The device and system according to the present invention will now be discussed in greater detail by reference to the drawings.

FIG. 1 illustrates a first embodiment of the present invention. Specifically, a plan view of the figurine depicting the planar facial region. The figurine includes a rigid head 1 which consists of a planar facial region 2 and a substantially spherical cranial region 3 (substantially spherical is intended to mean generally three dimensional and representational of a human or animal form). The figurine further comprises a body portion 5, which in the present example is representative of a human form. The figurine may be dressed in any type of clothes 6 desired and may be customized to reflect the hobbies or personality of the individual whose image is sublimated onto the planar facial region. The rigid head 1 is coupled to the body portion 5 of the figurine 7 by any means known in the doll or figurine art (not shown). The body portion 5 of the figurine may include rigid or semi-rigid feet 9 and hands or arms 8. The body portion of the present invention may be constructed of a washable material such that the entire doll may be cleaned if necessary or to protect the figurine from accidental liquid spills.

Figure 3:
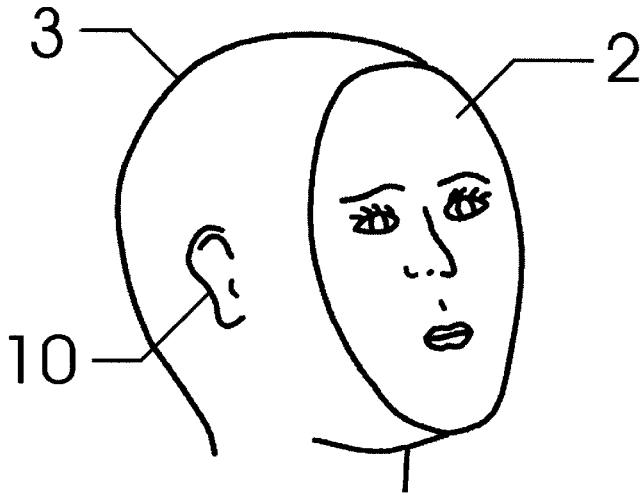
FIG. 3 is a perspective view of a figurine having a sublimated photographic image for a face.
Figure 2:
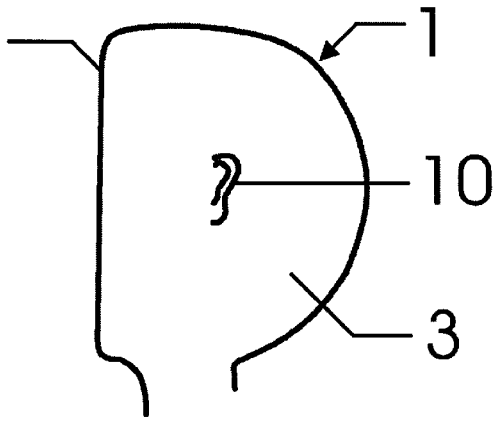
FIG. 2 is a side view illustrating the planar face portion of the rigid head.
Figure 4:
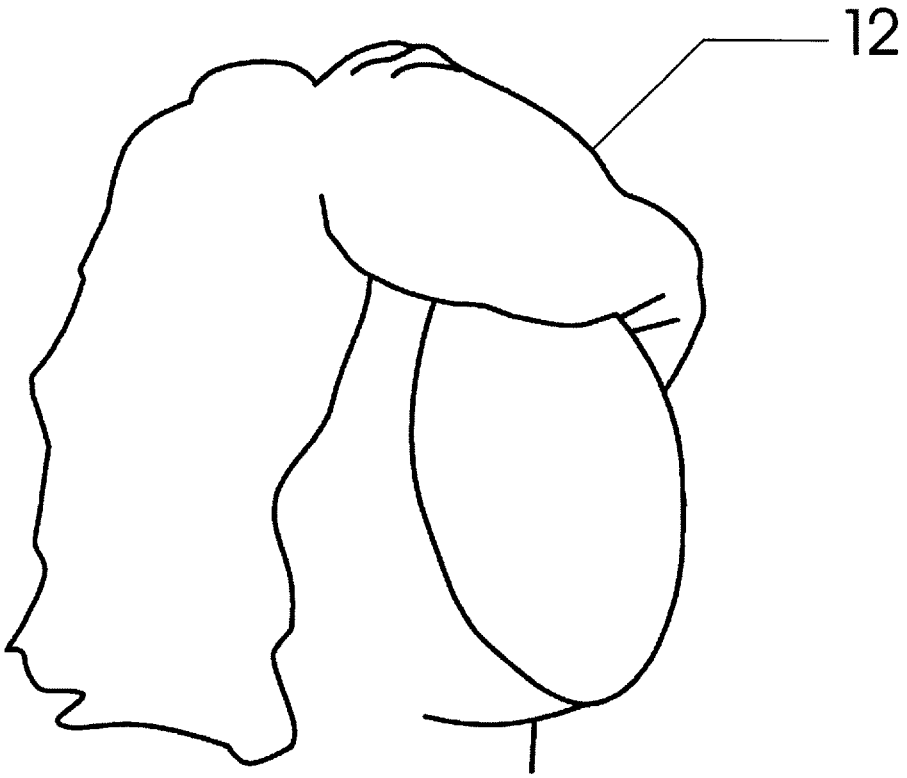
FIG. 4 is a perspective view of a figurine having a planar facial region, illustrating the use of soft fibrous hair added to enhance the realistic appearance of the figurine.

FIG. 2 illustrates a side view of the first embodiment of the figurine of the present invention. Specifically, the rigid head 1 which consists of a planar facial region 2 and a substantially spherical region 3. FIG. 3 and 4 illustrate further refinements to the rigid head of the figurine. FIG. 3 illustrates an advantage of the present invention over the prior art. Specifically, by utilizing a planar face region 2 and a substantially spherical region 3 (fabricated from a material such as clay), three dimensional physical characteristics such as ears 10 may be depicted. FIG. 4 illustrates soft fibrous hair 12 joined to the rigid head to make the figurine more realistic and lifelike.

Figure 5:
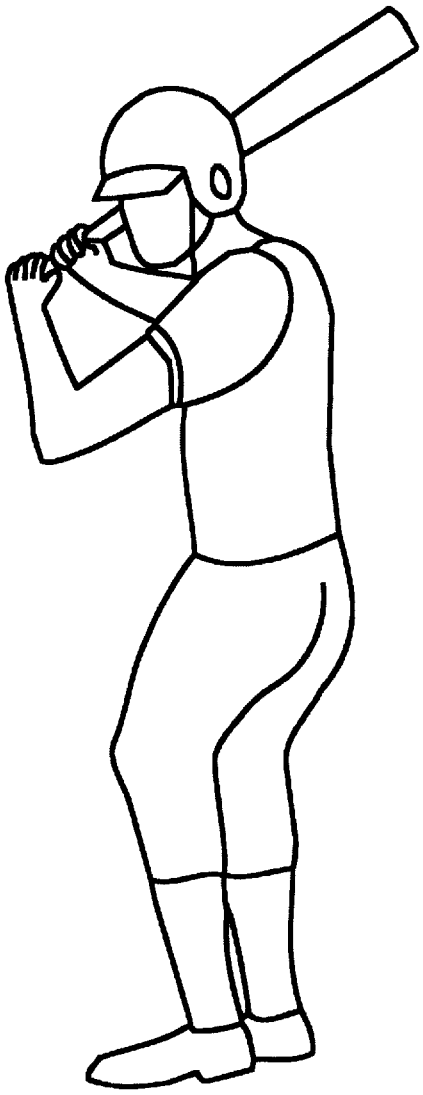
FIG. 5 is an alternative embodiment where the figurine is representative of an athlete.

FIG. 5 illustrates a first alternative embodiment of the present invention. Specifically, the figurine representative of a sports figure.

Figure 6:
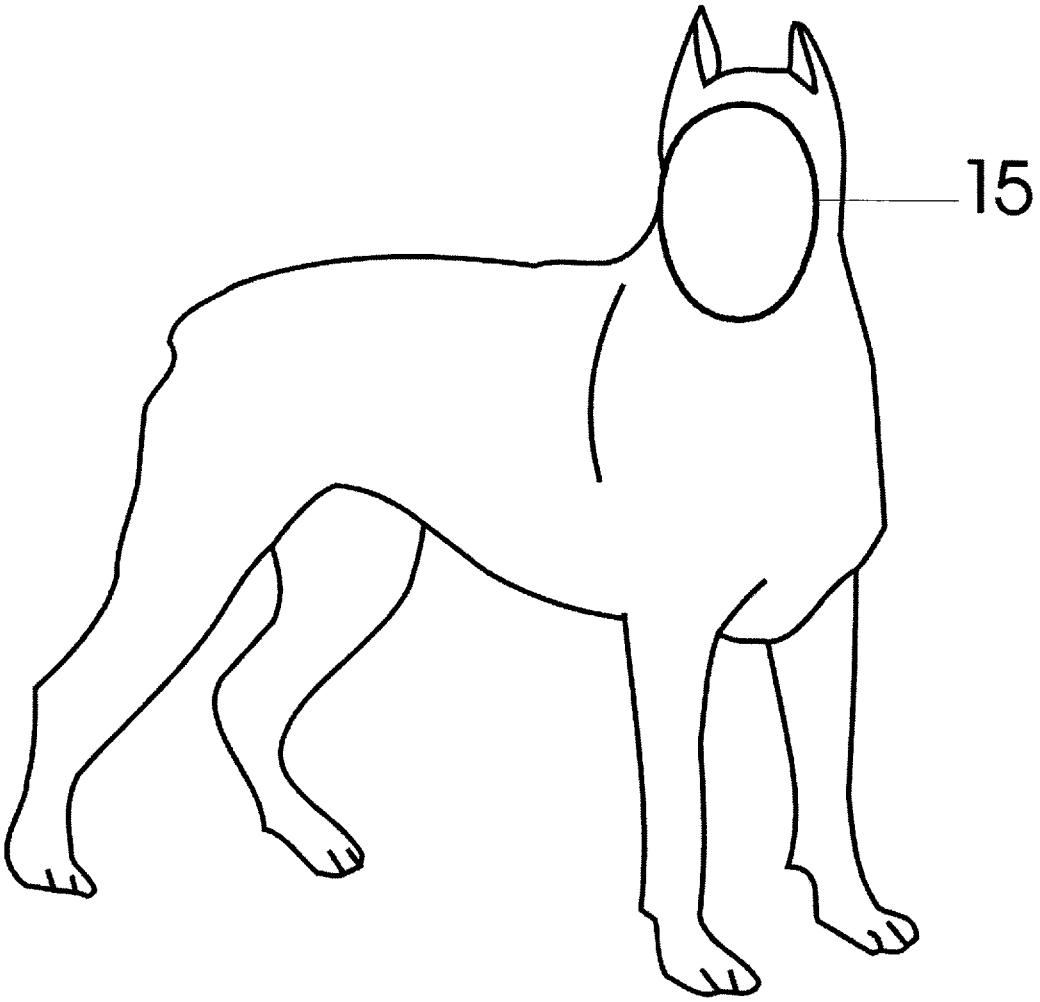
FIG. 6 is a second alternative embodiment where the figurine is representative of an animal.

FIG. 6 illustrates a second alternative embodiment of the present invention. Specifically, the figurine representative of an animal. In this embodiment a pet owner or animal lover could have a photograph of their pet transferred to the planar region 15 of the figurine.

Although this invention has been described in its preferred form with a certain degree of particularity with respect to a doll having a photographic image for a face, it is understood that the present disclosure of the preferred form has been made only by way of example and that numerous changes in the details of structures and the composition of the doll may be resorted to without departing from the spirit and scope of the invention.

Now that the invention has been described,

What is claimed is:

1. A method of manufacturing a figurine having an image permanently transferred into the facial region thereof by means of sublimation transfer, comprising:

providing a figurine having a molded rigid head, wherein the head includes an essentially planar facial region and a substantially spherical region said planar facial region having sublimation transfer receptor surface coating thereon;

introducing the image to be transferred by means of sublimation transfer into a computer scanner;

creating a digital image of said image;

manipulating said digital image to achieve desired size parameters; editing said digital image to produce desired color and image qualities;

printing said digital image using sublimatable dyes on a sublimatable transfer image sheet;

placing said transfer image sheet against said substantial planar facial region of said rigid head;

applying heat and pressure to sublimate dyes from the transfer image sheet onto said planar facial region of said figurine whereby said image is permanently transferred into the facial region of said figurine.

2. A method as in claim 1, wherein said rigid head is fabricated of ceramic.

3. A method as in claim 1 wherein said rigid head is fabricated from porcelain.

* * * * *